United States Patent [19]

Eckert

[11] 4,427,490

[45] Jan. 24, 1984

[54] DELIGNIFICATION AND BLEACHING PROCESS FOR LIGNOCELLULOSIC PULP WITH PEROXIDE IN THE PRESENCE OF METAL ADDITIVES

[75] Inventor: Robert C. Eckert, King County, Wash.

[73] Assignee: International Paper Company, New York, N.Y.

[21] Appl. No.: 253,294

[22] Filed: Apr. 13, 1981

Related U.S. Application Data

[63] Continuation of Ser. No. 139,658, Apr. 14, 1980, abandoned, which is a continuation of Ser. No. 51,171, Jun. 22, 1979, abandoned, which is a continuation of Ser. No. 894,561, Apr. 7, 1978, abandoned.

[51] Int. Cl.[3] ..... D21C 9/16

[52] U.S. Cl. ..... 162/78; 162/79; 252/186.1; 252/186.28; 252/186.33

[58] Field of Search ..... 162/65, 78, 79; 252/186, 186.1, 186.27, 186.33, 186.28; 8/111

[56] References Cited

U.S. PATENT DOCUMENTS

| | | | |
|---|---|---|---|
| 1,213,921 | 1/1917 | Liebknecht et al. | 423/273 |
| 1,758,920 | 5/1930 | Baum | 152/244 |
| 1,958,204 | 5/1934 | Reichert | 252/186 X |
| 2,004,809 | 6/1935 | Gilbert et al. | 23/251 |
| 2,081,327 | 5/1937 | Franz | 8/111 |
| 2,112,116 | 3/1938 | Richter | 260/101 |
| 2,119,519 | 6/1938 | Bragg | 8/2 |
| 2,173,474 | 9/1939 | Evoy | 162/78 |
| 2,187,016 | 1/1940 | Craig | 8/104 |
| 2,249,646 | 7/1941 | Brugg | 8/105 |
| 2,368,527 | 1/1945 | Edelstein | 162/78 |
| 2,975,169 | 3/1961 | Crunford et al. | 260/212 |
| 3,156,654 | 11/1964 | Konecny | 8/111 |
| 3,193,445 | 7/1965 | Parker | 162/78 |
| 3,462,344 | 8/1969 | Kindron et al. | 162/78 |
| 3,806,404 | 4/1974 | Leibergott et al. | 162/65 |

FOREIGN PATENT DOCUMENTS

| | | | |
|---|---|---|---|
| 1369662 | 5/1964 | France | 252/186 |
| 344054 | 8/1972 | U.S.S.R. | 162/65 |
| 699064 | 11/1979 | U.S.S.R. | 162/78 |

OTHER PUBLICATIONS

Wallace "Hydrogen Peroxide In Organic Chemistry", pp. 60–69.

Holladay et al., "The Bleaching of Pulp" Chapt. 9, 180–185, Mack Printing Co. 1963.

McCloskey et al.; "Catalytic Influence of Iron and Magnesium Ions in $O_2$ Bleaching Reactions" *TAPPI;* vol. 58, No. 2 2–1975.

Christensen; "Bleaching of Sulphate Pulps with Hydrogen Peroxide", Norsk Skogindustri, pp. 268–271.

Rapson; "The Role of pH in Bleaching Pulp", *TAPPI* pp. 284–294, vol. 39, No. 5.

Schurb et al.; *Hydrogen Peroxide,* pp. 658–661.

*Primary Examiner*—Steve Alvo

*Attorney, Agent, or Firm*—James F. Haley, Jr.; Robert M. Shaw

[57] ABSTRACT

A process and solution for delignifying and brightening lignocellulosic pulp. The solution comprises from about 0.1 to about 5% by weight, based on oven-dried pulp of a peroxide and about 0.5 to about 20 mole percent, based on the moles of peroxide, of a metal ion selected from the group consisting of tungsten, molybdenum, chromium, osmium and selenium. The preferred process of this invention comprises contacting a lignocellulosic pulp with about 0.5 to about 20 mole percent, based on moles of peroxide, of a metal ion selected from the group consisting of tungsten, molybdenum, chromium, osmium and selenium at a temperature below about 50° C.; adjusting the pH of the resultant pulp slurry to between about 1 and about 7; adding 0.1 to about 5% by weight based on oven-dried pulp of peroxide and effecting pulp delignification and brightening at about 30° C. to about 100° C. until most of the peroxide has been consumed.

8 Claims, No Drawings

DELIGNIFICATION AND BLEACHING PROCESS FOR LIGNOCELLULOSIC PULP WITH PEROXIDE IN THE PRESENCE OF METAL ADDITIVES

This is a continuation, of application Ser. No. 139,658, filed Apr. 14, 1980, which is now abandoned, which is a continuation of application Ser. No. 51,171, filed June 22, 1979, now abandoned, which is a continuation of application Ser. No. 894,561, filed Apr. 7, 1978, now abandoned.

BACKGROUND OF THE INVENTION

This invention relates to an improved process for delignifying and brightening lignocellulosic pulp. More particularly, the invention is directed at a peroxide-based delignifying and bleaching solution and process for lignocellulosic pulp. In this process a lignocellulosic pulp is contacted at a temperature below about 50° C. with a solution of metal ions selected from the group consisting of tungsten, molybdenum, chromium, osmium and selenium. The pH of the resultant slurry is adjusted to between about 1–7. A peroxide is added and pulp delignification and brightening effected at 30°–100° C. until most of the peroxide has been consumed. The process affords pulp delignification and brightening with minimal destruction of the cellulosic portion of the pulp.

Wood is composed of two main parts—a fibrous carbohydrate or cellulosic portion and a non-fibrous portion comprising a complex chemical, commonly referred to as lignin.

For use in paper-making processes, wood must first be reduced to pulp, which can be defined as wood fibers capable of being slurried or suspended and then deposited as a screen to form a sheet. The methods employed to accomplish this pulping usually involve either physical or chemical treatment of the wood or some combination of the two processes to alter its chemical form and to give desired paper properties.

In mechanical pulping, the wood is physically ground to a high-yield, lignin retained pulp, most often referred to as groundwood pulp. In chemical pulping, the wood chips are digested with a chemical solution to solubilize a portion of the lignin and effect its removal. The more usual of these digestive procedures are the sulfite, sulfate or Kraft, soda and modified sulfite processes.

After the wood has been digested or mechanically ground, the resulting material is generally a darkly colored cellulosic fiber. The dark color is attributable to the fact that not all of the lignin has been removed during digestion and none has been removed during mechanical processing. This dark pulp is commonly referred to as unbleached pulp. Unbleached pulp may pass directly to the paper making operation only if paper color is unimportant.

More usually, unbleached lignocellulosic pulps are bleached or brightened to a brightness consistent with the planned utilization of the pulp, brightness being a measure of pulp reflectivity under standardized conditions. Pulp bleaching is most often a multi-stage process employing various chemicals to remove or alter the lignin of the lignocellulosic pulp such that the resultant pulp is no longer light absorbing or dark in color.

Two classes of compounds generally find use as lignocellulosic brighteners, namely reducing agents and oxidizing agents. Common reducing agents include sulfurous acids, hydrosulphites, borohydrides, amine boranes, and bisulfites. Common oxidizing agents include chlorine-based compounds, peroxides, ozone, oxygen, peracids, permanganates and chromates.

The ready availability and environmentally appealing character of peroxides have made them increasingly popular in recent years as bleachants in the paper-making industry. Such peroxides are used in the "lignin retaining" bleaching of groundwood and other high yield pulps to provide substantial brightness gains, but not the high brightness attainable with chemical pulps. Such processes are described, for example, in Hook, "Peroxide Bleaching Opens New Potentials For Groundwood Pulps", *Pulp & Paper International,* 45–48 (June 1975), Vartiainen, "Utilization of Peroxide in Pulp Bleaching", *Papper Och Tra,* 51, 277–284 (1969), U.S. Pat. Nos. 2,187,016, 3,023,140, and 2,251,731 and Canadian Pat. No. 970,111. Additionally, peroxides are employed as a "capping" or super-bleach stage at the end of common multi-stage bleaching processes for chemical pulps. Exemplifying these processes are those described in Canadian Pat. Nos. 966,604 and 970,111, U.S. Pat. Nos. 3,193,445 and 3,462,344 and Vartiainen, "Utilization of Peroxide in Pulp Bleaching", *Papper Och Tra,* 51, 277–284 (1969), Delattre, "Hydrogen Peroxide as a Bleaching Agent for Kraft Pulps", *Papper Och Tra,* 117–127 (1971), Hartler et al., "Peroxide Bleaching of Kraft Pulps", *Tappi,* 43, 806–813 (1960), Christensen, "Bleaching Sulphate Pulp with Hydrogen Peroxide", Pulp and Paper Magazine of Canada, 62–66 (1971), Christensen, "Bleaching of Sulphate Pulps with Hydrogen Peroxide", Norsk Skogindustri, 268–271 (October, 1973), and Mlakar & Peltonen, "Peroxide in the Semi-bleaching of Kraft Pulp", *Papper Och Tra,* 11, 629–638 (1968).

However, peroxide bleaching by itself is not able to effect sufficient pulp bleaching for most paper-making requirements. This is particularly true when the peroxide is employed in an internal stage in a multi-stage bleaching process after initial ozone or oxygen bleaching. Previous variations of the conditions for peroxide-pulp contact have either not remedied this inferior bleaching characteristic or so degraded the cellulosic portion of the pulp that it was no longer useful for paper-making processes.

The failure of peroxide bleachants in internal or pre-bleaching stages is apparently due to the inability of peroxide to delignify lignocellulosic pulps sufficiently to remove the light-absorbing, dark lignin components and yet, maintain that resultant pulp viscosity and strength necessary for subsequent paper-making processes.

For example, at more alkaline pH's, i.e. 9–11, peroxide bleaching is usually conducted in the presence of sodium silicate and magnesium sulfate stabilizers to avoid peroxide decomposition by heavy metal contaminants. But, under such conditions substantially no delignification is obtained. At higher pH's auto-decomposition of the peroxide becomes excessive so as economically to disadvantage the process.

Conversely, at acid pH's, i.e. 2–7, the peroxide reaction with the lignin chromophores of the pulp is sluggish and often accompanied by severe visocisity losses. Rapson, "The Rule of pH in Bleaching Pulp", *Tappi,* 39, 284–294 (1956) and U.S. Pat. No. 2,112,116. Similar pulp viscosity and strength reductions are adduced by the addition of metals such as manganese, cobalt, iron, copper and aluminum to oxidizing bleaching agents such as peroxide. These special oxidants have been used to good advantage in U.S. Pat. Nos. 2,975,169 and 2,368,527 to produce pulp, which while unsuitable for paper manufacture, is well constituted for the production of viscose rayon or other cellulose-like derivatives.

Other additives are likewise ineffective in improving the brightness gain achievable with peroxide solutions. For example, U.S. Pat. Nos. 2,119,519 and 2,249,646 disclose the addition of titanium having a valence of less than four to oxidizing bleaching agents, including peroxides. This addition is said to activate the alkaline bleaching process so as to reduce both the treatment time and oxidant concentration needed to obtain a given level of brightness gain. Such reductions advantageously benefit pulp strength since viscosity losses and other pulp degradation are minimized due to the abbreviated oxidant-pulp content. However, even this improved process adduces no significant pulp delignification.

Peracids are one class of oxidizing bleaching agents which effect selective lignin removal. These reagents are essentially derivatives of peroxides. However, they are quite expensive and do not lend themselves to easy recovery and regeneration.

SUMMARY OF THE INVENTION

It is accordingly an object of this invention to provide a process and solution whereby peroxide may be employed to delignify selectively and brighten lignocellulosic pulp yet retard that pulp viscosity loss and degradation caused by cellulose oxidation.

Another object of this invention is to provide a peroxide based delignifying process and solution wherein the conditions of delignification avoid significant auto-decomposition of peroxide so as to require none of the conventional peroxide stabilizers.

A further object of this invention is to provide a pulp delignification and bleaching process and solution wherein the spent bleachants may be recovered in conventional recovery systems without scaling.

These and other additional objects and advantages of this invention, apparent from the detailed description and claims which follow, are accomplished in accordance with this invention by a pulp delignifying and brightening solution comprising from about 0.1 to about 5% by weight, based on O.D. (oven-dried) pulp, of a peroxide and about 0.5 to about 20 mole percent, based on moles of peroxide, of a metal ion selected from the group consisting of tungsten, molybdenum, chromium, osmium and selenium, and sufficient acid to maintain the pH of the solution between about 1 and about 7. More preferably, the acid is added subsequent to pulp-metal admixture.

In the preferred process of this invention, a lignocellulosic pulp is contacted at a temprature below about 50° C. with the metal solution. The pH of the resultant slurry is adjusted to between about 1 and about 7 and peroxide is added to the slurry. Pulp delignification and brightening are usually effected at about 30° to about 100° C. until most of the peroxide has been consumed.

DETAILED DESCRIPTION OF THE INVENTION

This invention relates to a peroxide-based solution and process for selectively delignifying and brightening lignocellulosic pulp. The solution and process avoid attack on the cellulosic portion of the pulp so as substantially to preclude degradation of the pulp and reduction of its viscosity to levels below those acceptable for paper-making processes. According to this invention, wood pulps and other lignocellulosic pulps may be utilized to good advantage. By way of example, prereferred lignocellulosic pulps include those wood pulps digested by the well-known sulfite, sulfate or Kraft, soda and modified sulfite processes. The process is particularly useful for the bleaching of hardwood Kraft pulps especially those which have been semi-bleached with conventional oxygen bleachants. Such semi-bleaching is disclosed, for example, in Soteland, "Bleaching of Chemical Pulps with Oxygen and Ozone", *Pulp and Paper Magazine of Canada,* 75, T153-158 (1974).

The novel delignifying and brightening solution of this invention comprises from about 0.1 to about 5% by weight, based on O.D. pulp, of a peroxide, about 0.5 to about 20 mole percent, based on moles of peroxide, of a metal ion selected from the group consisting of tungsten, molybdenum, chromium, osmium and selenium, and sufficient acid to maintain the pH of the solution between about 1 and about 7. More preferably the acid is added subsequent to pulp-metal admixture.

In the preferred process of this invention, a lignocellulosic pulp is contacted at a temperature below about 50° C. with such metal solution. The pH of the resultant slurry is adjusted to between about 1 and about 7 and peroxide added to the slurry. Pulp delignification and brightening are effected at about 30° C. to about 100° C. until most of the peroxide has been consumed. However, it is to be understood that other sequences which avoid pulp-peroxide contact at low pH and high temperature in the absence of metal ion are within the scope of the invention.

The methodology for carrying out this process in the pulp slurry is conventional in the art. Most commonly slurries of consistency from about 1% to about 50%, and more preferably 10% to 35% are employed. The reaction is conducted between 30° C. and 100° C. and more preferably between 50° and 80° C. The time of reaction is not critical being primarily controlled by the amount of peroxide remaining in the pulp slurry and its effective reaction rate. Usually a reaction time of from 0.5 to about 4 hours is sufficient to consume most of the peroxide, the choice of an actual reaction time being dependent on the pH and temperature. For example, short reaction times are favored in slurries of low pH and high temperature.

The peroxide used in the bleaching solution and process of this invention may be selected from any number of conventional sources. These include inorganic peroxides, such as sodium peroxide, organic peroxides and aqueous solutions of hydrogen peroxide itself, the last being preferred. The chosen peroxide or a mixture thereof may be used in an amount of from about 0.5 to about 5% by weight, based on O.D. pulp, but preferably is present between about 0.5 and about 2% by weight.

The peroxide stabilizers taught in the art to slow deleterious auto-decomposition of peroxide during bleaching are not needed in the slurries of this invention. Instead, the metallic activators of this invention appear both to stabilize the peroxide and to activate its selective oxidative attack on the lignin of the lignocellulosic pulp.

The metal containing additives, whose metallic portions are selected from the group consisting of tungsten, molybdenum, chromium, osmium and selenium, may be selected from a wide range of such compounds. The selected compounds need only be albe to provide the desired metallic ions in solution and not interfere with the pulp brightening process to be acceptable. Examples of useful compounds of this type include osmium tetroxide, selenium dioxide, sodium tungstate, sodium molybdate and sodium dichromate. More preferably, the metallic portion is tungsten and most preferably the tungsten is in the plus six oxidation state, since tungsten ions of lower oxidation states are more wasteful of peroxide. Although it is not necessary that the chosen additive be totally soluble under the conditions of this invention, such dissolution is more usual and preferred.

While not wishing to be bound by theory, it is thought that a 2:1 peroxo-tungstate or other metal-peroxide complex functions as the lignin selective oxidant. Its action is catalytic since the metal is returned to the reservoir of free peroxide to reform the reactive complex. At stoichiometric concentrations of metal ion, the competing metal induced peroxide decomposition appears to slow, the metal complex apparently having a stabilizing effect on the pulp.

As the pH of the slurry is lowered from 6 to about 2, pulp brightening and delignification seem to improve, but pulp viscosity losses become significant at below about pH 3. It is theorized that such improvement is a function of a favored formation of peroxo-metal complex at low pH. However, elevated temperatures may also force this formation at higher pH's. For example, pulp contact at pH 5 and 77° C. is very effective in delignification of lignocellulosic pulp. When tungsten is the metal ion employed, such conditions are preferred.

Following the selective delignification and brightening of this invention, the lignocellulosic pulp may be washed in a conventional manner or additionally treated in any number of well-recognized paper-making processes. The filtrate from such washing is amenable to standard recovery operations without scaling. Further, any metal residue remaining on the pulp fiber may serve as a pigment to build opacity.

Due to the relatively high cost of even the small amounts of metal ions used in this invention, it is important that thorough washing and a high degree of recycle be employed to improve the economics of the process of this invention.

In order to describe the present invention so that it may be more clearly understood, the following examples are set forth. These examples are primarily for the purpose of illustration and any specific enumeration therein should not be construed as a limitation on the broader concepts of this invention.

EXAMPLE I

A hardwood Ticonderoga mill pulp was pulped via a conventional Kraft process and semi-bleached by a conventional oxygen bleaching process to a 19.7 cp viscosity, 48.6 Elrepho brightness and 6.9 permanganate number. The pulp was contacted with a test solution comprising varying concentrations of hydrogen peroxide and tungsten metal ion. The resultant slurry, 10% consistency, was treated to adjust the pH to the desired test value and pulp-solution contact continued at 77° C. for 2 hours. After this bleaching treatment, the pulp was filtered and certain pulp properties were monitored. Subsequent to an alkaline extraction at pH 12.0, (70° C. for 90 minutes) these properties were measured again. The comparative results are displayed in Table I.

TABLE I

| | Initial Pulp | 1 | 2 | 3 | 4 | 5 | 6 |
|---|---|---|---|---|---|---|---|
| % $H_2O_2$ (O.D. pulp) | — | — | 1 | 2 | 1 | 1 | 1 |
| % Tungsten (O.D. pulp) | — | 0.30 | 0.15 | 0.15 | 0.06 | — | — |
| pH (initial) | — | 4.8 | 5.2 | 5.2 | 5.0 | 5.0 | — |
| pH (final) | — | 5.0 | 5.3 | 5.4 | 5.2 | 5.3 | 10.5 |
| Residual $H_2O_2$ (g/l) | — | — | 0.007 | 0.041 | 0.136 | 0.666 | 0 |
| Viscosity (cp)* | 19.7 | 19.7 | 18.1 | 25.6 | 16.8 | 14.2 | 19.4 |
| Elrepho Brightness* | 48.6 | 51.3 | 55.5 | 59.3 | 57.4 | 56.7 | 56.6 |
| Permanganate No. (25 ml)* | 6.9 | 6.1 | 4.0 | 3.0 | 3.5 | 5.7 | 6.0 |
| Viscosity (cp)** | — | 17.4 | 16.0 | 17.4 | 15.7 | 14.1 | —*** |
| Elrepho Brightness** | — | 51.2 | 55.9 | 60.0 | 56.7 | 56.1 | —*** |
| Permanganate No. (25 ml)** | — | 5.9 | 3.5 | 2.9 | 3.4 | 5.7 | —*** |

*Before alkaline extraction
**After alkaline extraction
***No reason to perform extraction This comparative testing demonstrates that in the absence of peroxide, tungsten ion does not bleach pulp (Test No. 1). Conversely, in the absence of metal ion in accordance with this invention, residual peroxide content is substantially higher and pulp viscosity significantly inferior to peroxide bleachants including such ions (Test No. 5). Test No. 6 is the control wherein the pulp is bleached using an alkaline peroxide process common in the art. Stabilizers of 0.05% magnesium sulfate and 5.0% sodium silicate are used in such control. The metallic bleachants of this invention provide substantially greater permanganate number reductions yet afford similar brightness gains and viscosity retention than the prior alkaline bleaching process.

EXAMPLE II

An unbleached hardwood pulp was pulped via a conventional Kraft process to a permanganate number of 9.9, viscosity of 28.0 and Elrepho brightness of 33.2. It was contacted with a solution of 2% hydrogen peroxide (based on O.D. pulp) containing 0.15% tungsten ion (based on O.D. pulp). The pH of the resultant slurry was adjusted to 5 and the bleaching continued at 77° C. for 2 hours. Subsequent to standard alkaline bleaching, the pulp displayed a permanganate number of 4.8, a viscosity of 15.0 and a brightness of 44.7. A control pulp, bleached under identical conditions but lacking tungsten, had a permanganate number of 7.6, a viscosity of 22.3 and a brightenss of 41.5.

EXAMPLE III

A hardwood Ticonderoga mill pulp was oxygen-bleached in the Pfaudler reactor to a permanganate number of 6.2, giving a 0.5% CED viscosity of 22.4 cp and a GE brightness of 46.5%. Peroxide bleaches were made on 100 gram O.D. batches of this pulp at 10% consistency and 77° C. The conditions of the peroxide stage are depicted in Table II.

Following peroxide bleaching, the pulp was bleached in two ozone stages separated by an extraction stage. In the first ozone stage, 0.8% ozone based on O.D. pulp was applied and in the second, 0.4% was employed. The ozone stages were conducted identically at pH 3, consistency 1.0% and 22° C. Extractions were made at pH 7.5, 6.0% consistency and 50° C.

TABLE II

| | OP*ZEZ | OPalkZEZ | OPaZEZ |
|---|---|---|---|
| % $H_2O_2$ (O.D. pulp) | 1.0 | 1.0[1] | — |
| % Pa (peracetic acid) (O.D. pulp) | — | — | 2.23[2] |
| % Tungsten Applied (O.D. pulp) | 0.3 | — | — |
| pH | 5 | 10.5 | 7.5 |
| Time (hours) | 2 | 2 | 3 |
| Permanganate Number[3] | 3.9 | 5.4 | 3.3 |
| Viscosity (cp)[3] | 22.5 | 21.8 | 22.1 |
| Brightness, % GE[3] | 54.4 | 60.2 | 67.7 |
| Yield %[3] | 99.0 | 98.7 | 98.5 |
| % Ozone Consumed, (O.D. pulp) First stage | 0.48 | 0.53 | 0.51 |
| Second stage | 0.27 | 0.28 | 0.28 |
| Viscosity (cp)[4] | 12.5 | 12.7 | 11.7 |
| Brightness, % GE[4] | 85.2 | 83.9 | 89.6 |
| Overall Yield %[4] | 93.2 | 96.4 | 96.0 |
| Reverted Brightness[4] | 77.3 | 80.3 | 84.0 |

[1]This bleachant included 5% sodium silicate and 0.05% magnesium sulfate by weight based on O.D. pulp.
[2]This is the molar equivalent of 1.0% $H_2O_2$ (O.D. pulp)
[3]Before ozone bleaching
[4]After final ozone bleaching and standard washing stages.

These results demonstrate that alkaline peroxide bleaching and bleaching in accordance with this invention are complimentary systems as interior bleaching stages. Alkaline peroxide provides mainly bleaching and the peroxides of this invention mainly provides delignification. However, the reactive conditions of the bleachants of these inventions are more compatible with subsequent low temperature acidic ozone stages. Therefore, such peroxide solutions are preferred for the interior stage of multi-stage bleaching sequences.

These results illustrate the usefulness of a variety of metal additives in accordance with this invention.

While I have hereinbefore presented a number of embodiments of my invention, it is apparent that my basic construction can be altered to provide other embodiments which utilize my invention. Thus, it will be appreciated that the scope of my invention is to be defined by the claims appended hereto rather than the specific embodiments which have been presented hereinbefore by way of example.

I claim:

1. A process for delignifying and brightening lignocellulosic pulp comprising maintaining the temperature of an aqueous hydrogen peroxide-containing pulp slurry between about 30° C. and 100° C. until the peroxide is substantially consumed, the pulp slurry comprising lignocellulosic pulp; from about 0.1 to about 5% by weight, based on oven-dried pulp, of hydrogen peroxide and about 0.5 to about 20 mole percent, based based on moles of the peroxide, of tungsten ion; and having a pH between about 3 and about 6; the peroxide and the tungsten ion, as present in the pulp slurry, consisting essentially of free peroxide, free tungsten ion and a peroxo-tungstate complex.

2. The process of claim 1 wherein the pH is 5 and the slurry temperature is 77° C.

3. A process for delignifying and brightening lignocellulosic pulp comprising admixing lignocellulosic pulp with an aqueous metal solution consisting essentially of about 0.1 to about 5% by weight, based on oven-dried pulp, of a peroxide, about 0.5 to about 20 mole percent, based on moles of the peroxide, of a metal ion selected from the group consisting of tungsten, molybdenum, chromium, osmium and selenium, and sufficient acid to maintain the pH of the resultant pulp slurry between about 1 and about 7, the slurry having a consistency from about 1% to about 50%, and maintaining the pulp slurry at a temperature between about 30° C. and about 100° C. until the peroxide is substantially consumed.

4. The process of claim 3 wherein the acid is added subsequent to admixing the pulp with the metal solution.

5. The process of claim 1 or 3 wherein the peroxide concentration is between about 0.5 and about 2% by weight.

6. The process of claim 3 wherein the peroxide is hydrogen peroxide.

7. The process of claim 3 wherein the metal ion is tungsten.

8. The process of claim 3 wherein the pH of the pulp slurry is maintained between about 3 and about 6.

* * * * *

UNITED STATES PATENT AND TRADEMARK OFFICE

CERTIFICATE OF CORRECTION

PATENT NO. : 4,427,490

DATED : January 24, 1984

INVENTOR(S) : Robert C. Eckert

It is certified that error appears in the above-identified patent and that said Letters Patent is hereby corrected as shown below:

At column 5, line 1, "albe" should be --able--.

At column 8, line 19 "base" (second occurrence) should be deleted.

Signed and Sealed this

*Nineteenth* Day of *February 1985*

[SEAL]

*Attest:*

DONALD J. QUIGG

*Attesting Officer* *Acting Commissioner of Patents and Trademarks*